US010551105B2

(12) United States Patent
Smith

(10) Patent No.: US 10,551,105 B2
(45) Date of Patent: Feb. 4, 2020

(54) MULTI-STAGE CONTROL FOR ELECTROMECHANICAL HEATING, VENTILATION, AND AIR CONDITIONING (HVAC) UNIT

(71) Applicant: TRANE INTERNATIONAL INC., Davidson, NC (US)

(72) Inventor: Sean A. Smith, Chapmansboro, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 226 days.

(21) Appl. No.: 15/224,905

(22) Filed: Aug. 1, 2016

(65) Prior Publication Data

US 2017/0030623 A1 Feb. 2, 2017

Related U.S. Application Data

(60) Provisional application No. 62/199,354, filed on Jul. 31, 2015.

(51) Int. Cl.
*F25B 49/02* (2006.01)
*F24F 11/86* (2018.01)

(52) U.S. Cl.
CPC ..... *F25B 49/022* (2013.01); *F24F 11/86* (2018.01); *F25B 2400/0751* (2013.01); *F25B 2600/02* (2013.01)

(58) Field of Classification Search
CPC ..... F25B 49/022; F25B 2400/0751; F25B 2600/01; F25B 2600/02; F25B 2600/025; F25B 2600/0251; F25B 2600/0252; F25B 2600/0253; F25B 2700/19; F25B 2700/2104; F25B 2700/2106; F24F 11/30; F24F 11/86
USPC ..... 337/3, 13, 16, 36–122, 359, 362–372, 337/379
See application file for complete search history.

(56) References Cited

U.S. PATENT DOCUMENTS 4,024,378 A * 5/1977 McIntosh ..... G05D 23/275 236/1 E
4,240,580 A * 12/1980 Fehr ..... B60H 1/00835 236/49.3
4,563,667 A * 1/1986 Hofsass ..... H01H 37/5427 337/349
4,760,955 A * 8/1988 Turner ..... G05D 23/32 236/68 C (Continued)

*Primary Examiner* — Jianying C Atkisson
*Assistant Examiner* — Tavia Sullens
(74) *Attorney, Agent, or Firm* — Hamre, Schumann, Mueller & Larson, P.C.

(57) ABSTRACT

A control system for a heat transfer circuit, an HVAC unit containing a heat transfer circuit, and a method of retrofitting an HVAC unit are described. The control system includes a thermostat having a first cooling stage signal output terminal and a second cooling stage signal output terminal; a controller electrically connected to the thermostat; a sensor electrically connected to the controller; and a switch electrically connected to the controller, and that receives a first cooling stage signal output from the thermostat. The switch is in a first state when a sensor value from the sensor is less than a threshold, and a second state when the sensor value from the sensor is greater than or equal to the threshold.

10 Claims, 3 Drawing Sheets

(56) References Cited

U.S. PATENT DOCUMENTS

| | | | | |
|---|---|---|---|---|
| 4,835,369 | A * | 5/1989 | Oslin | A47J 27/14 219/430 |
| 5,113,057 | A * | 5/1992 | Tsai | H05B 3/80 219/497 |
| 5,392,380 | A * | 2/1995 | Tsai | H05B 1/0213 219/523 |
| 6,370,894 | B1 | 4/2002 | Thompson et al. | |
| 6,728,600 | B1 * | 4/2004 | Contaldo | F23N 1/002 236/20 R |
| 6,925,999 | B2 | 8/2005 | Hugghins et al. | |
| 7,455,238 | B2 | 11/2008 | Hugghins | |
| 7,731,096 | B2 | 6/2010 | Lorenz et al. | |
| 7,819,331 | B2 | 10/2010 | Arneson | |
| 8,708,242 | B2 | 4/2014 | Conner et al. | |
| 2006/0032252 | A1 * | 2/2006 | Lee | F24F 11/30 62/228.5 |
| 2009/0140065 | A1 | 6/2009 | Juntunen et al. | |
| 2012/0023428 | A1 * | 1/2012 | Kennard | F24F 11/30 715/771 |
| 2014/0345308 | A1 * | 11/2014 | Del Toro | F25B 49/02 62/115 |
| 2015/0338133 | A1 * | 11/2015 | Havard, Jr. | F24F 11/30 62/175 |

* cited by examiner

MULTI-STAGE CONTROL FOR ELECTROMECHANICAL HEATING, VENTILATION, AND AIR CONDITIONING (HVAC) UNIT

FIELD

This disclosure relates generally to a heating, ventilation, and air conditioning (HVAC) unit. More specifically, this disclosure relates to providing additional stages of cooling in an HVAC unit.

BACKGROUND

A heating, ventilation, and air conditioning (HVAC) unit can include multiple stages of cooling. The multiple stages of cooling can provide improved efficiency as well as improved comfort for occupants in a conditioned space as compared to an HVAC unit providing a single stage of cooling.

SUMMARY

This disclosure relates generally to a heating, ventilation, and air conditioning (HVAC) unit. More specifically, this disclosure relates to providing additional stages of cooling in an HVAC unit.

In some embodiments, an HVAC unit includes a heat transfer circuit configured to condition a space (conditioned space). The HVAC unit can generally include, among other features, a plurality of compressors and a thermostat. In some embodiments, the compressors can be fixed speed compressors.

In some embodiments, the HVAC unit can include two compressors having fixed speeds, with one of the two compressors being relatively larger in capacity than the other of the two compressors. In some embodiments, the thermostat can include two cooling level signal outputs for requesting either a first stage of cooling or a second stage of cooling. The HVAC unit can also include a sensor and a switch. The sensor and switch can selectively enable either a first of the two compressors or a second of the two compressors such that either a first stage of cooling or a second stage of cooling is enabled in response to a signal output from a first of the two cooling level signal outputs. A second of the two cooling level signal outputs can enable both the first and the second compressors, thereby enabling a third stage of cooling. In some embodiments, this enables an HVAC unit configured to provide two stages of cooling to be able to provide an additional third stage of cooling. In some embodiments, the second cooling level signal output includes both the first and the second cooling level signal outputs.

In some embodiments, the sensor and switch can be retrofitted into an existing HVAC unit in order to increase a number of stages of cooling the HVAC unit is capable of providing. In some embodiments, the sensor and switch can be a single device. For example, in some embodiments, the sensor and switch can be a bimetallic thermal switch.

In some embodiments, when a first cooling level signal is output, the sensor and switch can be selected such that a first stage of cooling is provided when a sensor value determined from the sensor is either above or below a sensor value threshold. For example, a first stage of cooling may be provided when the sensor value is below a particular temperature. In such embodiments, a second stage of cooling may be provided when the sensor value is greater than or about the same as the sensor value threshold. For example, a second stage of cooling may be provided when the sensor value is at or above the particular temperature. In such embodiments, when a second cooling level signal is output, a third stage of cooling may be provided.

In some embodiments, the sensor can be a temperature sensor, a pressure sensor, a timer, a humidity sensor, or the like.

In some embodiments, the HVAC unit can include more than two compressors.

A control system for a heat transfer circuit is described. The control system includes a thermostat having a first cooling level signal output terminal and a second cooling level signal output terminal; a controller electrically connected to the thermostat; a sensor electrically connected to the controller; and a switch electrically connected to the controller, and that receives a first cooling level signal output from the thermostat. The switch is in a first state when a sensor value from the sensor is less than a threshold, and a second state when the sensor value from the sensor is greater than or equal to the threshold. The first cooling level signal output enables a first cooling stage or a second cooling stage and a second cooling level signal output enables a third cooling stage.

A heat transfer circuit is described. The heat transfer circuit includes a plurality of compressors, each of the plurality of compressors having different capacities; and a control system. The control system includes a thermostat having a first cooling level signal output terminal and a second cooling level signal output terminal; a controller electrically connected to the thermostat; a sensor electrically connected to the controller; and a switch electrically connected to the controller, and that receives a first cooling level signal output from the thermostat. The switch is in a first state when a sensor value from the sensor is less than a threshold, and a second state when the sensor value from the sensor is greater than or equal to the threshold. The first cooling level signal output enables a first cooling stage or a second cooling stage and a second cooling level signal output enables a third cooling stage.

A method of retrofitting a heating, ventilation, and air conditioning (HVAC) unit, the HVAC unit including a thermostat and a plurality of compressors, the thermostat including a first cooling level output terminal and a second cooling level output terminal, is described. The method includes connecting a switch in electrical communication with the thermostat and the plurality of compressors, such that the switch is electrically connected to the first cooling level output terminal; and connecting a sensor in electrical communication with the thermostat and the switch, the sensor being configured to selectively modify a state of the switch based on a sensor value, such that the switch controls whether a first of the plurality of compressors is enabled or a second of the plurality of compressors is enabled. The method further includes connecting the plurality of compressors to the second cooling level output terminal such that all of the plurality of compressors are enabled when a second cooling level output signal is output from the second cooling level output terminal.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

This disclosure relates generally to a heating, ventilation, and air conditioning (HVAC) unit. More specifically, this disclosure relates to providing additional stages of cooling in an HVAC unit.

An HVAC unit can include multiple stages of cooling. Some HVAC units include two stages of cooling. In such HVAC units, however, it may be beneficial to include a third stage of cooling. In some cases, adding the third stage of cooling may be required by, for example, a governmental agency, such as, but not limited to, states that adopt efficiency standards. Examples of efficiency standards include, but are not limited to, American Society of Heating, Refrigerating, and Air Conditioning Engineers (ASHRAE) 90.1 and 90.2 or the like. In such cases, it would be beneficial to retrofit an HVAC unit having two stages of cooling to include the third stage of cooling rather than replacing the entire HVAC unit. It may further be beneficial to provide the third stage of cooling to an HVAC unit having two stages of cooling without requiring a new HVAC controller.

An "HVAC unit," as described herein, can generally include a refrigeration unit including a plurality of compressors. In some embodiments, one of the plurality of compressors has a greater capacity than another of the plurality of compressors. In some embodiments, the plurality of compressors are fixed speed compressors.

Aspects described in this specification can be applied to other types of HVAC units, equipment, and/or systems, for example, but not limited to split systems, unitary equipment, rooftop equipment, water source heat pumps, chillers, or the like.

A "controller," as described herein, can generally include a mechanical controller (e.g., without digital controls). In some embodiments, the system and method as described herein can also apply to a digital controller.

Figure 1:
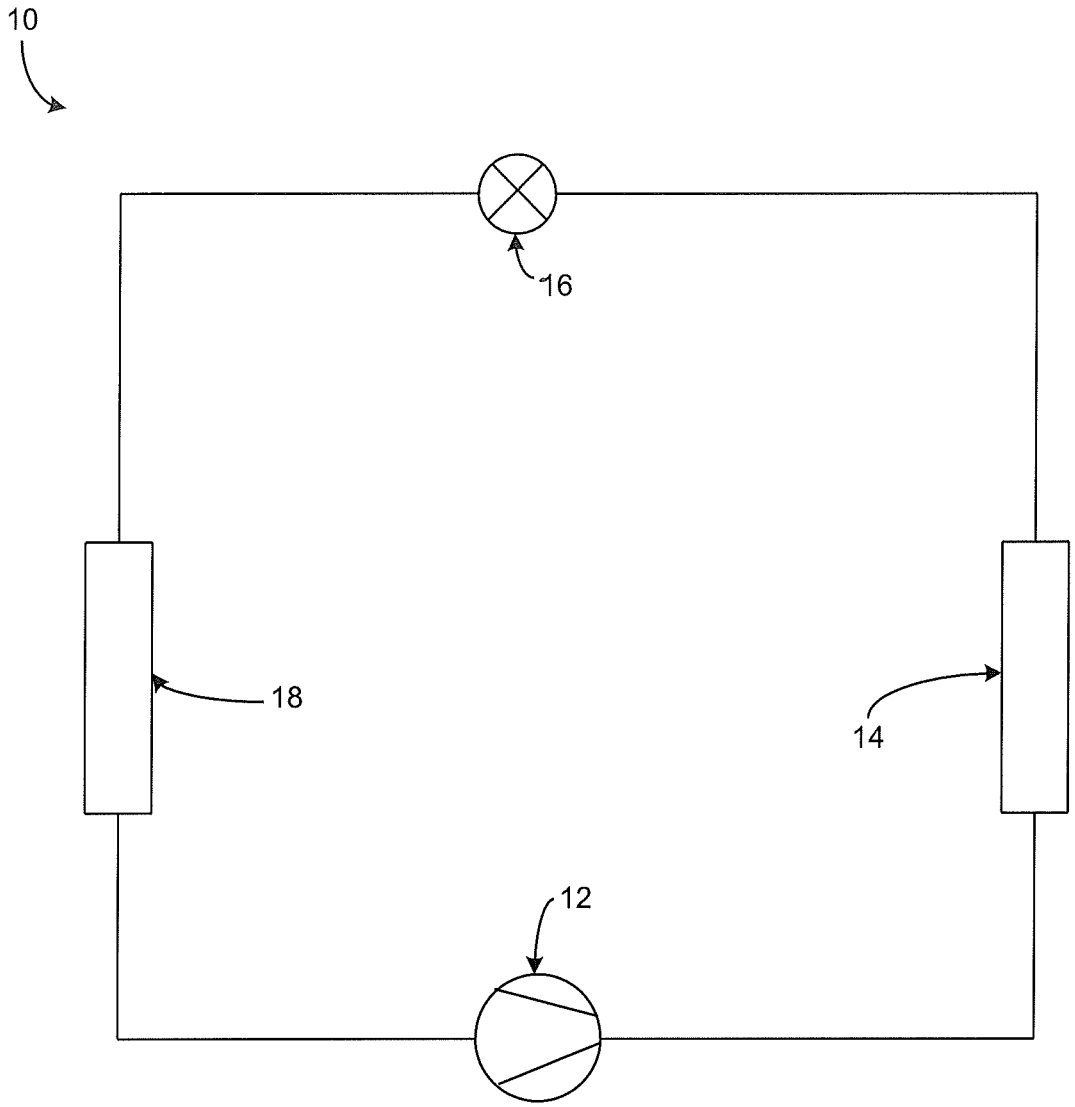
FIG. 1 is a schematic diagram of a heat transfer circuit, according to some embodiments.

FIG. 1 is a schematic diagram of a heat transfer circuit 10, according to some embodiments. The heat transfer circuit 10 generally includes a compressor 12, a condenser 14, an expansion device 16, and an evaporator 18. The heat transfer circuit 10 is exemplary and can be modified to include additional components. For example, in some embodiments the heat transfer circuit 10 can include an economizer heat exchanger, one or more flow control devices, a receiver tank, a dryer, a suction-liquid heat exchanger, or the like. In some embodiments, the heat transfer circuit 10 can include a plurality of compressors 12. In some embodiments, the plurality of compressors 12 can include compressors having different capacities.

The heat transfer circuit 10 can generally be applied in a variety of systems used to control an environmental condition (e.g., temperature, humidity, air quality, or the like) in a space (generally referred to as a conditioned space). Examples of systems include, but are not limited to, heating, ventilation, and air conditioning (HVAC) systems, transport refrigeration systems, or the like.

The components of the heat transfer circuit 10 are fluidly connected. The heat transfer circuit 10 can be specifically configured to be a cooling system (e.g., an air conditioning system) capable of operating in a cooling mode. Alternatively, the heat transfer circuit 10 can be specifically configured to be a heat pump system which can operate in both a cooling mode and a heating/defrost mode.

Heat transfer circuit 10 operates according to generally known principles. The heat transfer circuit 10 can be configured to heat or cool a heat transfer fluid or medium (e.g., a liquid such as, but not limited to, water or the like), in which case the heat transfer circuit 10, in some embodiments, may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump. In some embodiments, the air conditioner or heat pump can be included, for example, in a rooftop HVAC unit or the like.

In operation, the compressor 12 compresses a heat transfer fluid (e.g., refrigerant or the like) from a relatively lower pressure gas to a relatively higher-pressure gas. The relatively higher-pressure gas is discharged from the compressor 12 and flows through the condenser 14. In accordance with generally known principles, the heat transfer fluid flows through the condenser 14 and rejects heat to a heat transfer fluid or medium (e.g., water, air, etc.), thereby cooling the heat transfer fluid. The cooled heat transfer fluid, which is now in a liquid form, flows to the expansion device 16. The expansion device 16 reduces the pressure of the heat transfer fluid. As a result, a portion of the heat transfer fluid is converted to a gaseous form. The heat transfer fluid, which is now in a mixed liquid and gaseous form flows to the evaporator 18. The heat transfer fluid flows through the evaporator 18 and absorbs heat from a heat transfer medium (e.g., water, air, etc.), heating the heat transfer fluid, and converting it to a gaseous form. The gaseous heat transfer fluid then returns to the compressor 12. The above-described process continues while the heat transfer circuit is operating, for example, in a cooling mode (e.g., while the compressor 12 is enabled).

Figure 2:
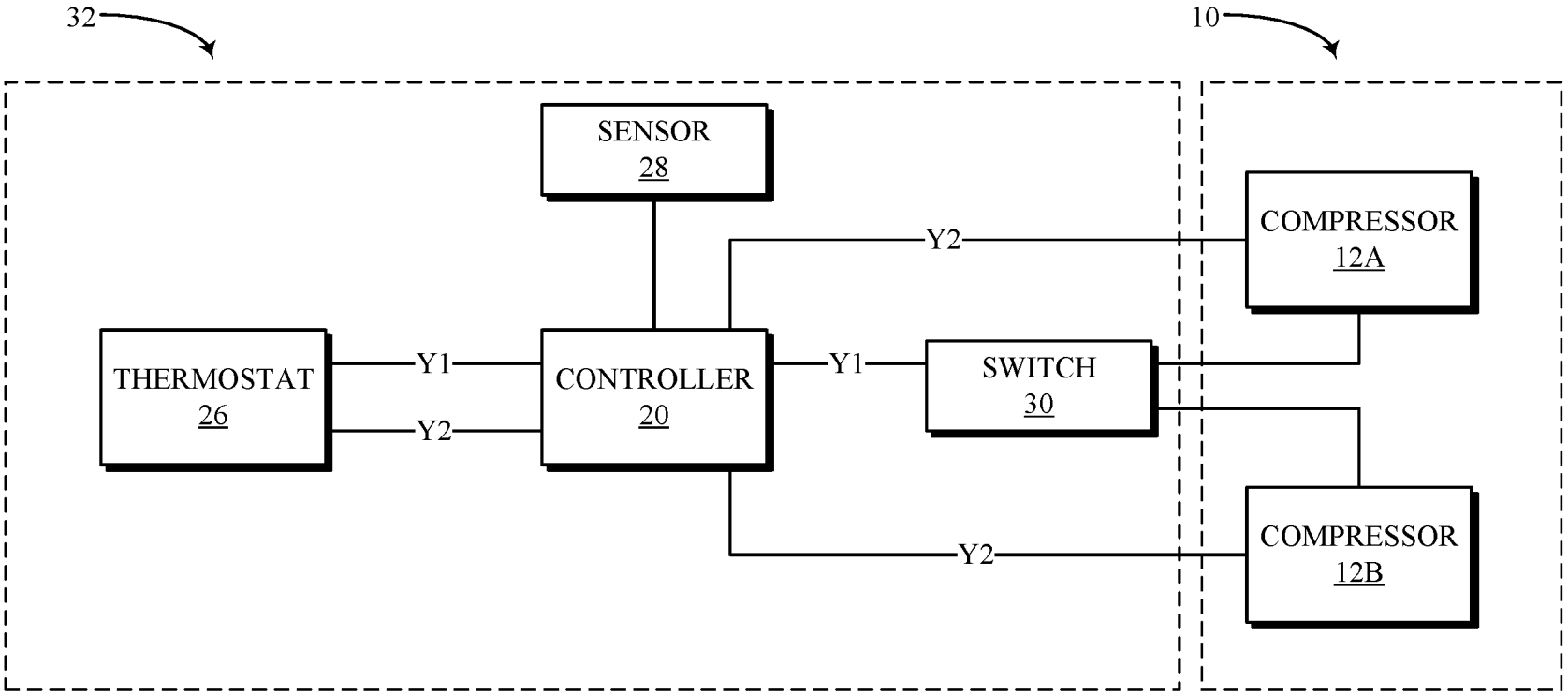
FIG. 2 is a schematic diagram of a control system for an HVAC unit, according to some embodiments.

FIG. 2 is a schematic diagram of a control system 32 for a heat transfer circuit (e.g., the heat transfer circuit 10 of FIG. 1), according to some embodiments. It will be appreciated that FIG. 2 illustrates an overview of the control system 32 and that additional aspects may be present in the control system 32. For example, the control system 32 can include one or more additional thermostats, one or more additional sensors, one or more additional compressors, or the like. In general, the control system 32 operates the heat transfer circuit 10 to meet one or more environmental conditions (e.g., temperature, humidity level, air quality, etc.) in a conditioned space (not shown).

In some embodiments, the control system 32 includes a thermostat 26, a controller 20, a sensor 28, and a switch 30. It will be appreciated that in some embodiments the control system 32 can include fewer aspects.

Generally, the thermostat 26 is included in the conditioned space being conditioned by the heat transfer circuit 10. The thermostat 26 is generally representative of a two-level thermostat configured to work with a two-stage HVAC system (e.g., an HVAC system that provides two stages of cooling). The thermostat 26 includes two cooling level signal outputs Y1 and Y2. When the thermostat 26 detects a need for cooling, the thermostat 26 outputs a cooling level signal from the cooling level signal output Y1, the cooling level signal output Y2, or both of the cooling level signal outputs Y1 and Y2. Both compressors 12A, 12B are enabled in response to the cooling level signal output Y1 and Y2. As discussed in further detail below (and additionally in accordance with FIG. 3 below), the cooling level signal output Y1 generally can be used to enable either the compressor 12A or the compressor 12B.

The controller 20 is electrically connected to the sensor 28, the switch 30, and the compressors 12A, 12B. The controller 20 can be configured to manage, command, direct, and regulate the behavior of one or more components of the heat transfer circuit 10 and/or the control system 32, such as, but not limited to, enabling and/or disabling the compressors 12A, 12B. The controller 20 can control the heat transfer circuit 10 to obtain various operating conditions such as, but not limited to, temperature, humidity, and/or air quality in a conditioned space.

The compressors 12A, 12B can be, for example, but are not limited to, scroll compressors. In some embodiments, the compressors 12A, 12B can be other types of compressors. Examples of other types of compressors include, but are not limited to, screw compressors, reciprocating compressors, positive displacement compressors, centrifugal compressors, or other types of compressors suitable for use in the heat transfer circuit 10. The compressors 12A, 12B are generally representative of fixed speed compressors. In some embodiments, the compressors 12A, 12B can alternatively be step control compressors (e.g., compressors having two or more steps within a compressor). In some embodiments, the compressors 12A, 12B can be compressors having different capacities. For example, compressor 12A can have a relatively greater capacity than compressor 12B, according to some embodiments. It will be appreciated that alternatively the compressor 12B can have a relatively greater capacity than compressor 12A.

The sensor 28 can be a variety of different sensor types. In some embodiments, the sensor 28 can be a temperature sensor that senses an ambient temperature. In some embodiments, the sensor 28 can be a refrigerant pressure sensor. In some embodiments, the sensor 28 can be a barometric pressure sensor. In some embodiments, the sensor 28 can be a timer that senses an amount of time during which a particular stage of cooling has been active. In some embodiments, the sensor 28 can be a humidity sensor that senses a return, supply, or fresh air humidity. It will be appreciated that the sensor 28 can be other types of sensors, according to some embodiments. In general, the sensor 28 can provide a sensor value to the controller 20. The sensor value can be provided at regular intervals (e.g., every n seconds, n minutes, etc.) or can be provided when requested by the controller 20. The sensor 28 is illustrated as being separate from the controller 20. It will be appreciated that the sensor 28 could alternatively be incorporated with the controller 20, according to some embodiments.

The sensor 28 and the sensor values it provides are generally used when the controller receives the cooling level output signal Y1 from the thermostat 26. The controller 20 can change a state of the switch 30 based on the sensor value. The state of the switch 30 can control whether compressor 12A or compressor 12B is enabled in response to the cooling level signal output Y1. This determination can, for example, provide a first stage of cooling by enabling compressor 12A or a second stage of cooling by enabling compressor 12B. It will be appreciated that the sensor 28 can be combined with the switch 30 such that, for example, depending upon a sensor value the switch 30 is mechanically placed in either a first state or a second state.

For example, in some embodiments, the sensor 28 and the switch 30 can be combined. For example, the switch 30 can be a bimetallic thermal switch. Bimetallic thermal switches operate according to generally known principles in which a bimetallic strip deflects based on temperature changes. In such an embodiment, the bimetallic switch could be configured such that in one state the bimetallic switch enables the compressor 12A and in another state, the bimetallic switch enables the compressor 12B. The particular bimetallic switch can be selected with a particular temperature at which either compressor 12A would be enabled or compressor 12B would be enabled. The temperature selected can be, for example, selected to maximize the applied HVAC unit efficiency or to maximize comfort in the conditioned space. In some embodiments, the bimetallic switch can be used in combination with a timer to, for example, prevent short cycling of the compressor.

In the preceding description, the switch 30 is operable based on the cooling level signal output Y1 signal from the thermostat 26 and controller 20. It will be appreciated that the above description can alternatively apply to the cooling level signal output Y2 from the thermostat 26 and the controller 20. In such an embodiment, the cooling level signal output Y1 would be provided to enable both compressors 12A and 12B.

Figure 3:
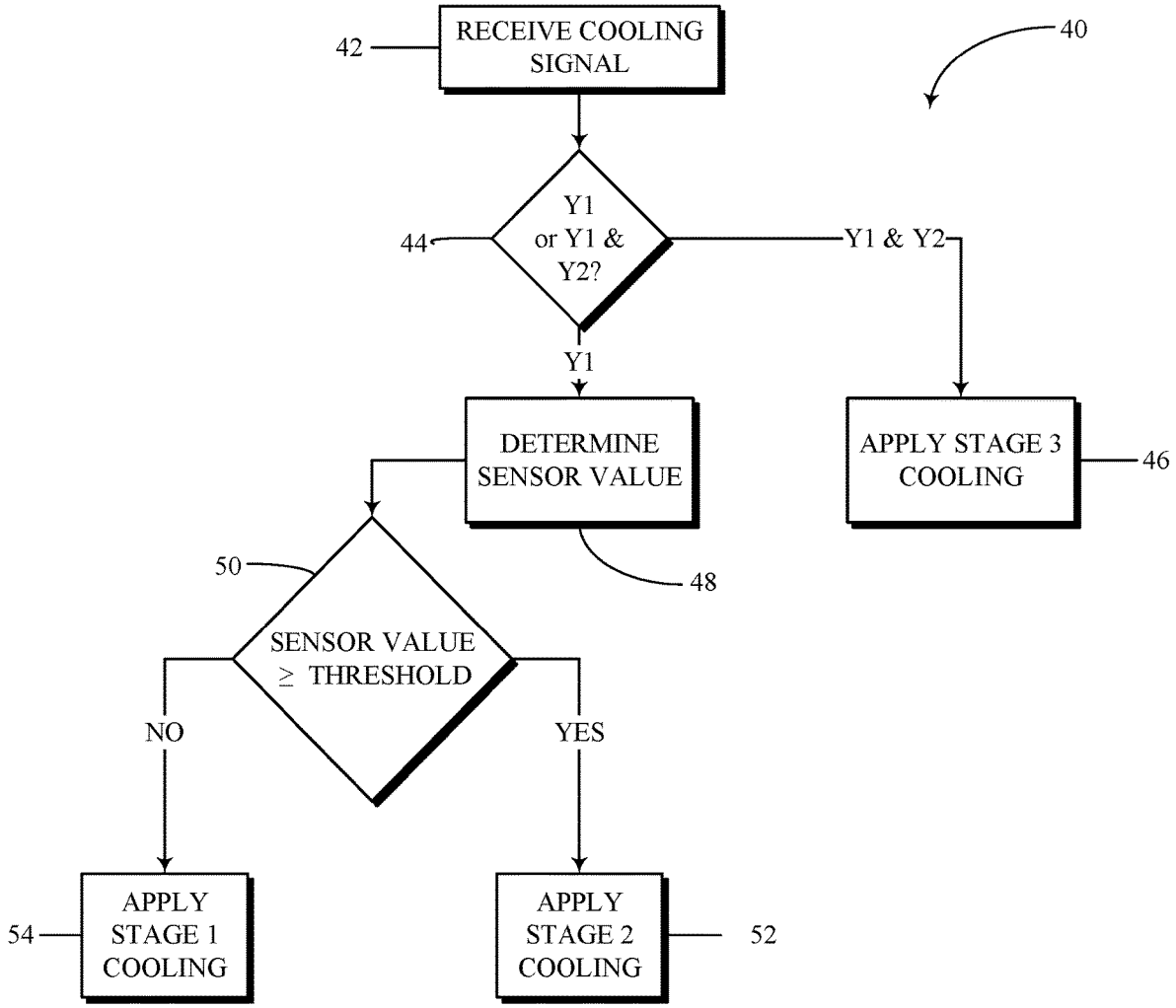
FIG. 3 illustrates a flowchart of a method for operating a controller for an HVAC unit, according to some embodiments.

FIG. 3 illustrates a flowchart of a method 40 for operating a control system (e.g., the control system 32 of FIG. 2) for a heat transfer circuit (e.g., the heat transfer circuit 10 of FIG. 1), according to some embodiments. The method 40 is generally described with reference to a "cooling" signal. It will be appreciated that in some embodiments the method 40 can be similarly operated for a "heating" signal. For example, if the heat transfer circuit 10 is embodied in a heat pump system, the method 40 may be applicable for either a heating signal or a cooling signal.

The method 40 begins when a cooling signal (e.g., a cooling level signal output Y1 or Y1 and Y2 of FIG. 2) is received by a controller (e.g., the controller 20 of FIG. 2) at 42. As described above with respect to FIG. 2, the cooling signal is generally received from a thermostat (e.g., the thermostat 26 of FIG. 2) at either a Y1 terminal or a Y2 terminal of the controller 20.

At 44, the controller 20 determines whether the cooling signal was received at the Y1 terminal or at the Y1 and the Y2 terminals.

If at 44 the controller 20 determines that the cooling signal was received at the Y1 and Y2 terminals, the controller 20 applies stage 3 cooling at 46 (e.g., a third stage of cooling). Generally, stage 3 cooling includes powering all compressors in the heat transfer circuit 10 (e.g., compressors 12A and 12B of FIG. 2). It will be appreciated that stage 3 cooling can be referred to alternatively as maximum cooling or the like. The term stage 3 cooling is not intended to be limiting. It will be appreciated that other terms may be used in which the compressors in the heat transfer circuit 10 are enabled in accordance with the description in this specification.

If at 44 the controller 20 determines that the cooling signal was received at the Y1 terminal, the controller 20 determines a sensor value at 48. At 50 the determined sensor value is compared with a sensor value threshold. If at 50 the determined sensor value is less than the sensor value threshold, the controller 20 applies stage 1 cooling at 54 (e.g., first stage cooling). If at 50 the determined sensor value is greater than or equal to the sensor value threshold, then the controller 20 applies stage 2 cooling at 52 (e.g., a second stage of cooling).

At 46, 52, and 54, cooling may be applied as long as a cooling signal is being received from the controller 20. In some embodiments, the method 40 may return from 54 or 52 to 48 and repeat as long as a cooling signal is being received. In this manner, the output signal Y1 can initially start stage 1 or stage 2 cooling and can switch from stage 1 cooling to stage 2 cooling or vice versa.

Aspects:

It is to be appreciated that any one of aspects 1-7 can be combined with any one of aspects 8-15, and 16-18. Any one of aspects 8-15 can be combined with any one of aspects 16-18.

Aspect 1. A control system for a heat transfer circuit, comprising:

a thermostat having a first cooling level signal output terminal and a second cooling level signal output terminal;

a controller electrically connected to the thermostat;

a sensor electrically connected to the controller; and a switch electrically connected to the controller, and that receives a first cooling level signal output from the thermostat, wherein the switch is in a first state when a sensor value from the sensor is less than a threshold, and a second state when the sensor value from the sensor is greater than or equal to the threshold, and wherein the first cooling level signal output enables a first cooling stage or a second cooling stage and a second cooling level signal output enables a third cooling stage.

Aspect 2. The control system according to aspect 1, wherein the switch is electrically connected to a first compressor and a second compressor, such that when the switch is in the first state, the first compressor receives the first cooling level signal output from the thermostat.

Aspect 3. The control system according to aspect 2, wherein when the switch is in the second state, the second compressor receives the first cooling level signal output from the thermostat.

Aspect 4. The control system according to any one of aspects 2-3, wherein the first and second compressors receive the second cooling level signal output from the thermostat.

Aspect 5. The control system according to any one of aspects 1-4, wherein the sensor is one of a temperature sensor, a pressure sensor, a timer, and a humidity sensor.

Aspect 6. The control system according to aspect 5, wherein the sensor and the switch are combined.

Aspect 7. The control system according to aspect 6, wherein the combined sensor and switch are a bimetallic thermal switch.

Aspect 8. A heat transfer circuit, comprising:

a plurality of compressors, each of the plurality of compressors having different capacities; and a control system, comprising:

a thermostat having a first cooling level signal output terminal and a second cooling level signal output terminal;

a controller electrically connected to the thermostat;

a sensor electrically connected to the controller; and a switch electrically connected to the controller, and that receives a first cooling level signal output from the thermostat, wherein the switch is in a first state when a sensor value from the sensor is less than a threshold, and a second state when the sensor value from the sensor is greater than or equal to the threshold, and wherein the first cooling level signal output enables a first cooling stage or a second cooling stage and a second cooling level signal output enables a third cooling stage.

Aspect 9. The heat transfer circuit according to aspect 8, wherein the first cooling level signal output enables one of the plurality of compressors based on a state of the switch.

Aspect 10. The heat transfer circuit according to aspect 9, wherein a first of the plurality of compressors is enabled when the switch is in the first state.

Aspect 11. The heat transfer circuit according to any one of aspects 9-10, wherein a second of the plurality of compressors is enabled when the switch is in the second state.

Aspect 12. The heat transfer circuit according to any one of aspects 8-11, wherein all of the plurality of compressors are enabled in response to the second cooling level signal output from the thermostat.

Aspect 13. The heat transfer circuit according to any one of aspects 8-12, wherein the sensor is one of a temperature sensor, a pressure sensor, a timer, and a humidity sensor.

Aspect 14. The control system according to aspect 13, wherein the sensor and the switch are combined.

Aspect 15. The control system according to aspect 14, wherein the combined sensor and switch are a bimetallic thermal switch.

Aspect 16. A method of retrofitting a heating, ventilation, and air conditioning (HVAC) unit, the HVAC unit including a thermostat and a plurality of compressors, the thermostat including a first cooling level output terminal and a second cooling level output terminal, the method comprising:

connecting a switch in electrical communication with the thermostat and the plurality of compressors, such that the switch is electrically connected to the first cooling level output terminal; and connecting a sensor in electrical communication with the thermostat and the switch, wherein the sensor is configured to selectively modify a state of the switch based on a sensor value, such that the switch controls whether a first of the plurality of compressors is enabled or a second of the plurality of compressors is enabled; and connecting the plurality of compressors to the second cooling level output terminal such that all of the plurality of compressors are enabled when a second cooling level output signal is output from the second cooling level output terminal.

Aspect 17. The method according to aspect 16, wherein the switch and the sensor are combined.

Aspect 18. The method according to aspect 16, wherein the combined switch and sensor is a bimetallic thermal switch.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are examples only, with the true scope and spirit of the disclosure being indicated by the claims that follow.

What is claimed is:

1. A method of retrofitting a heating, ventilation, and air conditioning (HVAC) unit, the HVAC unit including a thermostat, a plurality of compressors, and a controller electrically connected to the thermostat, the thermostat including a first cooling level output terminal configured to provide a first cooling level signal output and a second cooling level output terminal configured to provide a second cooling level signal output, the method comprising:

connecting a bimetallic thermal switch in electrical communication with the controller, wherein the bimetallic thermal switch is configured to be in a first state in which the controller is electrically connected to a first of the plurality of compressors based on a temperature being less than a threshold, and wherein the bimetallic thermal switch is configured to be in a second state in which the controller is electrically connected to a second of the plurality of compressors based on a temperature being greater than or equal to the threshold; and connecting the plurality of compressors to the second cooling level output terminal such that all of the plurality of compressors are enabled when the second cooling level output signal is output from the second cooling level output terminal.

2. A heat transfer circuit, comprising:

a plurality of compressors, each of the plurality of compressors having different capacities; and a control system, comprising:

a thermostat having a first cooling level signal output terminal configured to provide a first cooling level signal output and a second cooling level signal output terminal configured to provide a second cooling level signal output;

a controller electrically connected to the thermostat; and a bimetallic thermal switch electrically connected to the controller, and configured to receive the first cooling level signal output from the thermostat, wherein the bimetallic thermal switch is configured to be in a first state in which the controller is electrically connected to a first of the plurality of compressors in response to a temperature being less than a threshold, wherein the bimetallic thermal switch is configured to be in a second state in which the controller is electrically connected to a second of the plurality of compressors in response to a temperature being greater than or equal to the threshold, and wherein the first cooling level signal output is configured to enable a first cooling stage or a second cooling stage and the second cooling level signal output is configured to enable a third cooling stage.

3. The heat transfer circuit according to claim 2, wherein the first of the plurality of compressors is configured to be enabled when the bimetallic thermal switch is in the first state to enable the first cooling stage.

4. The heat transfer circuit according to claim 2, wherein the second of the plurality of compressors is configured to be enabled when the bimetallic thermal switch is in the second state to enable the second cooling stage.

5. The heat transfer circuit according to claim 2, wherein all of the plurality of compressors are configured to be enabled in response to the second cooling level signal output from the thermostat to enable the third cooling stage.

6. A control system for a heat transfer circuit, comprising:

a thermostat having a first cooling level signal output terminal configured to provide a first cooling level signal output and a second cooling level signal output terminal configured to provide a second cooling level signal output;

a controller electrically connected to the thermostat; and a bimetallic thermal switch electrically connected to the controller and selectively electrically connected to a first compressor and a second compressor, and configured to receive the first cooling level signal output from the thermostat, wherein the bimetallic thermal switch is configured to be in a first state in which the controller is electrically connected to the first compressor in response to a temperature being less than a threshold, wherein the bimetallic thermal switch is configured to be in a second state in which the controller is electrically connected to the second compressor in response to a temperature being greater than or equal to the threshold, and wherein the first cooling level signal output is configured to enable a first cooling stage or a second cooling stage and the second cooling level signal output is configured to enable a third cooling stage.

7. The control system according to claim 6, wherein in the first state, the first compressor is configured to receive the first cooling level signal output from the thermostat to enable the first cooling stage.

8. The control system according to claim 6, wherein in the second state, the second compressor is configured to receive the first cooling level signal output from the thermostat to enable the second cooling stage.

9. The control system according to claim 6, wherein the first and second compressors are configured to receive the second cooling level signal output from the thermostat to enable the third cooling stage.

10. The control system according to claim 1, further comprising a timer.

* * * * *